United States Patent [19]

Brors

[11] Patent Number: 4,875,629

[45] Date of Patent: Oct. 24, 1989

[54] PARTICLE PULVERIZER INJECTION NOZZLE

[75] Inventor: Kenneth A. Brors, New Brighton, Minn.

[73] Assignee: Air Powder Systems, Hastings, Minn.

[21] Appl. No.: 240,841

[22] Filed: Sep. 2, 1988

[51] Int. Cl.[4] ..... B02C 19/06

[52] U.S. Cl. ..... 241/39; 241/41

[58] Field of Search ..... 241/5, 39, 40, 41, 42, 241/43; 51/439

[56] References Cited

U.S. PATENT DOCUMENTS

| | | | |
|---|---|---|---|
| 238,044 | 2/1881 | Luckenbach . | |
| 1,020,743 | 3/1912 | Burlingham . | |
| 2,315,083 | 3/1943 | Chesler | 83/46 |
| 2,385,508 | 9/1945 | Hammond | 241/5 |
| 2,821,346 | 1/1958 | Fisher | 241/39 |
| 3,424,386 | 1/1969 | Maasberg | 239/427.3 |
| 4,186,772 | 2/1980 | Handleman | 137/604 |
| 4,538,764 | 9/1985 | Dunbar | 241/5 |

FOREIGN PATENT DOCUMENTS

| | | | |
|---|---|---|---|
| 838671 | 12/1938 | France | 51/439 |
| 999800 | 10/1951 | France | 51/439 |
| 663604 | 12/1951 | United Kingdom | 51/439 |

*Primary Examiner*—Timothy V. Eley

*Attorney, Agent, or Firm*—Merchant, Gould, Smith, Edell, Welter & Schmidt

[57] ABSTRACT

Disclosed is an injector (21) for use in an impact pulverizer (20) which reduces the size of particulate matter such as sand. An inlet chamber and frustum member (38) direct the particles through a bore (42) and into a outlet channel (49) in the barrel of the injector (48). An inlet (55) directs high velocity air tangentially into a manifold (57), creating a vacuum proximate the nozzle tip (67) which causes acceleration of the particles into the barrel (48). A threaded portion (54) allows the nozzle member (52) to be adjusted so as to vary the air flow characteristics for obtaining the maximum rate of production of the pulverized particles.

14 Claims, 3 Drawing Sheets

PARTICLE PULVERIZER INJECTION NOZZLE

FIELD OF THE INVENTION

The present invention relates to the art of pulverizing granular material such as sand, pigments, toner, graphite, clay, coal, cinder, cement, ore, and the like. More particularly, the present invention relates to a new injector for use within an impact pulverizer for projecting solid particles.

BACKGROUND OF THE INVENTION

There are many applications in the industrial arts which require that various kinds of material be pulverized to a high degree of fineness. For example, the production of paint pigments and ceramic materials requires the particles to be on the order of 10 microns or smaller in diameter, i.e., in the ultrafine range.

Various methods and apparatus for pulverizing substances have been proposed in the past, including crushing, stamping, grinding, and forcing the substance against a metallic disk by means of a powerful current of air. These devices have proven to be inefficient and expensive, because of the rapid wear and destruction of the working parts of the apparatus.

The most effective of these methods and apparatus have been pulverizers of the type in which material in the form of large granules is thrown against a plate or wall and broken up by impact, and pulverizers in which the particles are thrown toward each other by two or more converging streams. These impact pulverizers are, however, subject to the difficulties that the plate wears out rapidly, that often the plate material becomes undesirably entrained with the material being pulverized, and that the pulverized material is often undesirably coarse for many desired uses.

One difficulty with conventional impact pulverizers is that the conventional jets or injectors have suffered from undue turbulence and less effective impact of the solid particles, which tends to increase wear and reduce the efficiency of the grinding operation to an unwarranted and undesired extent. The jets or nozzles within the pulverizers quickly become unduly and rapidly worn, often wearing eccentrically. This results in shortened periods of operation and relatively high repair or replacement costs. In addition, the construction of these pulverizers is such that replacement of the worn part often necessitates replacement of the entire assembly. In many pulverizers, it is also difficult to disassemble the device in order to inspect or repair a worn part.

The present invention addresses these and many other problems associated with currently available pulverizers.

SUMMARY OF THE INVENTION

The present invention relates to a method and apparatus for obtaining particles having a fineness which can be utilized in different industries. The injector design of the present invention is quite efficient in the production of these fine particles.

The present invention comprises an injector for projecting solid material into the concussion chamber of an impact pulverizer. The injector has a nozzle member having a central conduit with an inlet end and an outlet end, there being a nozzle tip proximate the outlet end. Means are provided for circulating the solid particles to the inlet end of this conduit. There is also a barrel in axial alignment with the conduit which carries the entrained particles to the concussion chamber, the barrel having a diameter larger than the diameter of the conduit. A circumferential air passage surrounds the nozzle member, with one end of the air passage being in fluid communication with the barrel. Within the air passage is an inlet aperture, through which the motive fluid is supplied in a tangential direction into the air passage. In the preferred embodiment, the nozzle member is adjustable in the longitudinal direction by rotating a threaded portion of the nozzle member. Such adjustment of the nozzle member varies the flow characteristics of the air passage according to the particular operating conditions. The present invention is also directed toward certain critical angles and ratios which result in the optimum grind rate, minimal wear of the nozzle tip, and most efficient air flow characteristics.

A particular advantage of the present invention is that the pulverizer's design produces less undesirable turbulence and eddying which results in lost energy. Consequently, the particulate matter exits the nozzle and enters the impact chamber at a greater velocity. Also, the pulverizer of the present invention has the ability to communicate a large volume of particle material at a high rate, on the order of double the rate of production of a pulverizing apparatus having a conventional injector design.

Another feature of the present invention is that worn parts are easily replaceable with a minimal expenditure of time, expense and effort. The components of the pulverizer of the present invention are interconnected so as to facilitate easy disassembly. In addition, a removable, replaceable liner is provided, which surrounds the conduit which transports the material to be pulverized. This design allows the relatively inexpensive liner piece to be replaced periodically while the remainder of the device can be utilized for an extended period of time.

Another feature of the present invention is that the position of the injector components is adjustable. This feature is advantageous in order to accommodate different operating conditions, including different types of materials to be pulverized which may require different energy levels. Specifically, the cross-sectional area of the air passage is adjustable in order to vary the air flow of the motive fluid as desired, as compared to conventional pulverizers which typically have a fixed diameter air nozzle.

Another feature of the present invention is that the abrasion of the injector by the solid particles is kept to a minimum. The compressed air which transports the particles enters tangentially and moves in a rotational manner, thus providing a decreased amount of wear. The wear which does occur within the injector of the present invention is distributed uniformly and concentrically around the injector nozzle and is therefore less detrimental than eccentric wear. The particles are directed by means of a vacuum along a course which will provide appropriate alignment with the colliding course of particles from an opposing injector.

For a better understanding of the invention, and of the advantages obtained by its use, reference should be made to the Drawings and accompanying descriptive matter, in which there is illustrated and described a preferred embodiment of the invention.

BRIEF DESCRIPTION OF THE DRAWINGS

Referring to the Drawings, wherein like reference numerals indicate like parts throughout the several views.

DETAILED DESCRIPTION OF THE PREFERRED EMBODIMENT

Figure 1:
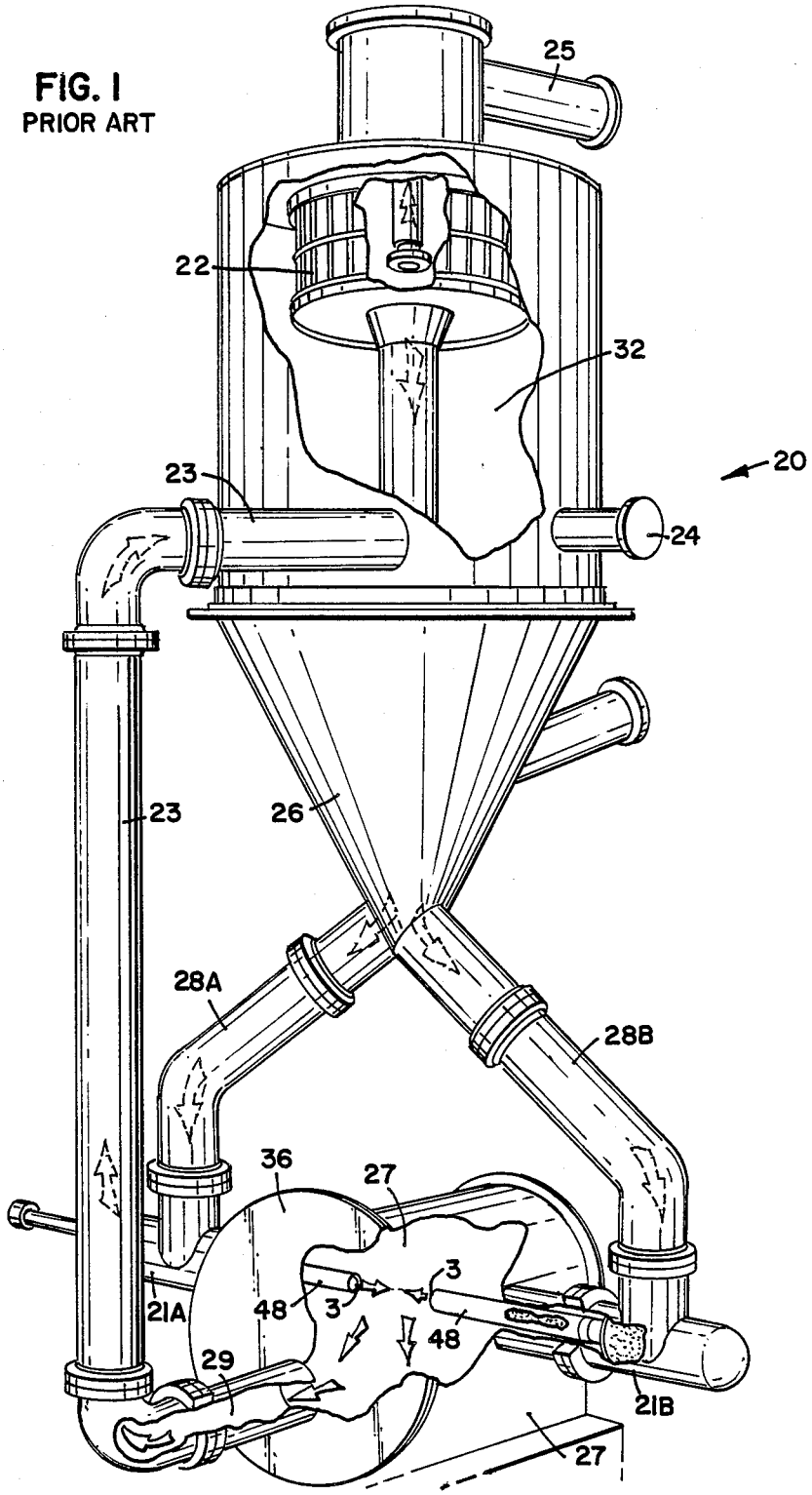
FIG. 1 PRIOR ART
FIG. 1 is a schematic view of a conventional impact pulverizer utilized with the injector of the present invention.

FIG. 1 illustrates a conventional, opposed-jet type of pulverizer 20 with a mechanical classifier. A similar pulverizer and classifier apparatus is described in Dunbar, U.S. Pat. No. 4,538,764. The fluidized particles enter the classifier chamber 32 through an inlet 24. There are suitable valve connections between the air inlet pipe 24 and the air compressor or steam generator (not shown) for controlling the current emanating from the compressor or generator. The power of the compressor is set at the appropriate level to adjust the pressure according to the particular operating conditions. The classifying means 22 sorts the particles by lifting the particles of a desired size upwardly and out of the classifying chamber 32 by exit conduit 25. The coarser, heavier particles which are larger than the desired size are passed downwardly by gravity through a chamber 26 for grinding. In the preferred embodiment, the classifier 22 is adjustable so as to withdraw particles of the particular, desired size. The particles enter a comminution or pulverization zone 27 by means of feed lines 28A and 28B.

The pulverizer 20 has at least two injectors 21A and 21B, and the present invention is directed toward a new design for the injectors 21. The injectors 21A and 21B produce opposed jets of fluid-borne particles which are fired at each other, creating millions of collisions which break the particles in the process of attrition or comminution. The high velocity of the fluid streams causes a breaking or tearing effect on the particles as they impinge on each other and upon the walls of the pulverization zone 27. The fluid stream carries the particles to classifying means 22 via a return line 23, and the classifier 22 sorts or removes the desired fraction of particles for use and returns the rest for regrinding. The material which meets at the converging chamber 27 will not all be reduced to a powder on its first concussion, but will fall out of the current. The fine entrained particles are carried out of the pulverization zone 27 through the outlet 29 and into the return conduit 23. In line 23 the fluid and particles are combined with fresh particles and enter the classifier 22 for removal of the desired particles and recycling of the larger particles for further pulverization.

Figure 2:
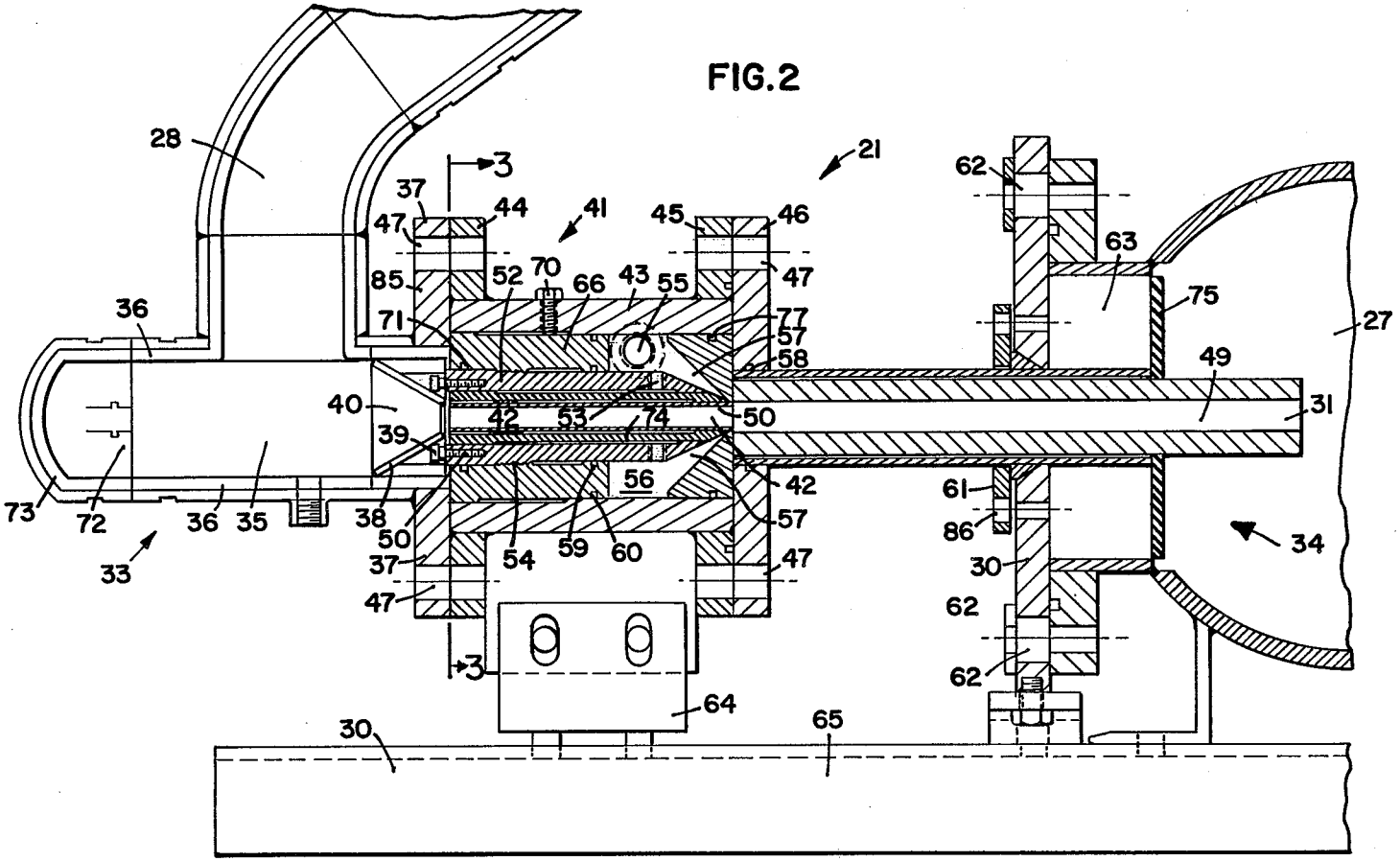
FIG. 2 is a side sectional view of the injector of the present invention.

FIG. 2 illustrates a sectional view of the injector 21 of the present invention. Although only one injector 21 is illustrated in FIG. 2, it is to be understood that the other injectors 21 directed into the impact chamber 27 are of the same design. Although a pair of the injectors 21A, 21B are shown in the embodiment of FIG. 1, the injectors 21 may be utilized in any number greater than one where the particles are to be reduced in size by the collision of the particles with each other. The axes of the plurality of the injectors 21 would generally meet or intersect at the center of an impact space like the chamber 27.

The discharge ends 31 of each injector 21 terminate at a suitable distance from each other. In the preferred embodiment, each injector 21 is fitted with a barrel 48 of suitable length to allow for an appropriate distance between the discharge ends 31. Alternatively, adjustment means can be provided for the longitudinal adjustment of the barrels 48 in order to vary the distance between the discharge ends 31 of the injectors 21. The optimal distance is determined by a variety of factors, including the quantity of the particles, the average size and specific gravity of the solid particles, and the pressure of the motive fluid.

The injector 21 has an inlet end 33 and an opposite outlet end 34. The central portion of the injector 21 is indicated generally 41. The entrained particles enter the injector 21 at the inlet end 33, pass through the central portion 41 and are impacted by the high-velocity motive fluid, then pass through the injector's outlet end 34 and into the impact chamber 27.

The conduit or elbow 28 terminates in a tee intersection at an inlet chamber 35, the point at which the granular material enters the injector 21. The inlet chamber 35 has suitable walls 36 preferably made of an abrasion-resistant material. A rubber material 75 may be affixed to the chamber wall 36. In the preferred embodiment, the end of the inlet chamber 35 proximate end 33 of the injector has a removable end cap 73. The removable end cap 73 facilitates replacement and repair of the injector components and also facilitates longitudinal adjustment of the nozzle, as described below. The opposite end of the inlet chamber housing 36 has a flange 37. The flange 37 is provided with a plurality of openings to facilitate connection of the flange 37 with an adjacent flange 85 on the central portion 41 of the injector 21.

At one end of the inlet chamber 35 is a frustum member 38 which is preferably held in place by four fasteners 39 such as screws. The frustum member 38 is hollow so as to provide a central axial passage 40 therethrough in the form of a tapering conical conduit. The diameter of the wide portion of the frustum member 38 is the same as the diameter of the inlet chamber 35, whereas the diameter of the opposite end of the frustum member 38 is slightly larger than the diameter of a central bore or conduit 42 in the central portion 41 of the injector 21. In the preferred embodiment, the angle of taper of the frustum member 38 with respect to the horizontal is approximately 60°.

The central portion 41 has a longitudinal bore 42 for transport of the granular material. The central portion 41 is mounted within a suitable cylindrical housing 43. In the preferred embodiment, the housing 43 has a pair of flanges 44, 45 on each end for attachment to adjacent flanges 37, 46 by means of suitable fasteners 47.

Proximate the discharge end 34 of the injector 21 is a longitudinal barrel 48. In the preferred embodiment, the barrel 48 has a length to diameter ratio of approximately 20:1. The barrel has a central, longitudinal channel 49 having an axis which is in alignment with the longitudinal axis of the nozzle conduit 42.

The barrel 48 may be made of a variety of materials depending upon different operating considerations. For example, the barrel may be made of alumina to prolong the wear resistance and life of the component; tungsten carbide could be utilized if a hard, long-lasting material is desired; and steel could be utilized when relatively soft particles such as toner are being pulverized.

The barrel 48 is attached to the impact chamber by fasteners which are external to the chamber 27. In the preferred embodiment, a dresser gasket 61 and suitable fasteners such as bolts 62, 86 are utilized to interconnect the barrel 48 with the framework 63 of the impact housing 27. The barrel 48 is interconnected to the barrel flange 46 by means of a suitable fastener arrangement, preferably including an O-ring 58.

A liner or nozzle sleeve 50 is positioned within an insert piece 74, and the cylindrical liner 50 forms the bore 42. Preferably, the liner 50 is held in place by a suitable adhesive. The liner 50 may be replaced with minimal effort by removing the end cap 73 and frustum member 38 and withdrawing the liner 50 in the left direction as viewed in FIGS. 2 and 4. The liner 50 is made of a material which is highly resistant to abrasion by the solid particles. The liner 50 is made out of tungsten carbide in the preferred embodiment. Alternatively, the nozzle insert assembly or liner 50 may be made of composite material: an inside cylindrical layer of a ceramic material and an outer cylindrical layer of an epoxy material.

Surrounding the insert piece 74 is a nozzle member 52. The insert piece 74 is slip fit into the nozzle member 52 and secured with a plurality of set screws 53. In the preferred embodiment, the nozzle member 52 is made of a suitable material such as low carbon steel. The inside diameter of the nozzle member 52 is sized and configured to accommodate the insert piece 74. The nozzle member 52 terminates in a substantially pointed nozzle tip 67 proximate its discharge end. The nozzle member 52 is cylindrical throughout most of its length, with one end of the nozzle member 52 having a tapered portion 68.

Figure 4:
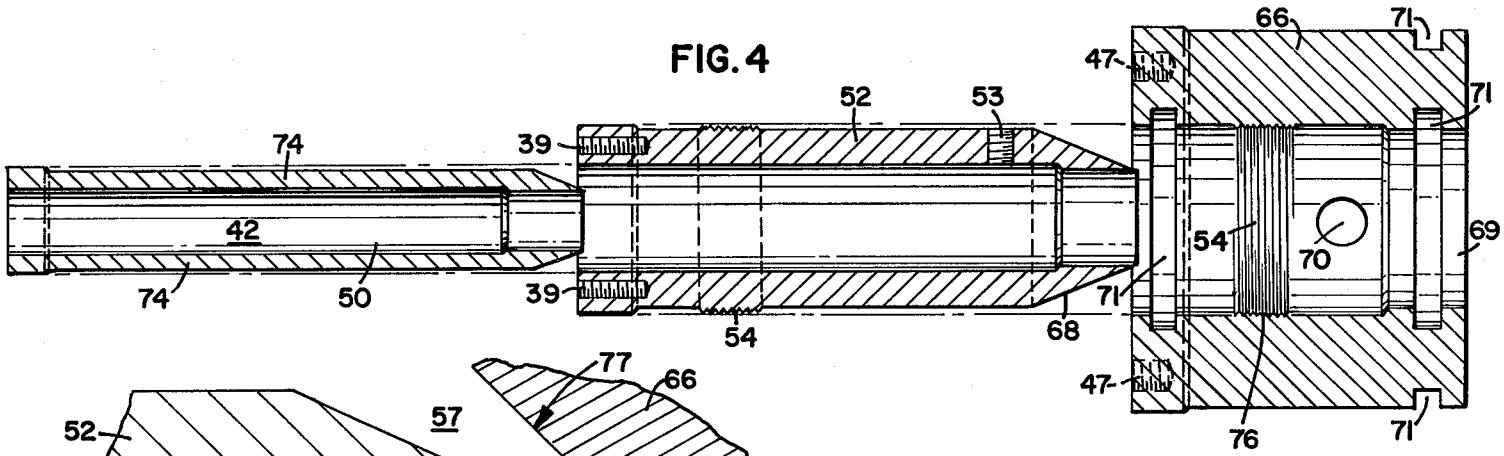
FIG. 4 is an exploded, sectional view of the nozzle of the present invention.
Figure 3:
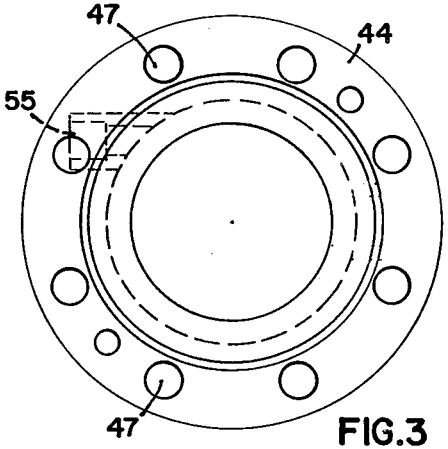
FIG. 3 is a cross-sectional view, taken at line 3—3 of FIG. 2.

An outer shell member 66 surrounds the nozzle member 52, as illustrated in FIGS. 2 and 4. The outer shell 66 is preferably cylindrical in shape, having a central bore 69 which has an inside diameter corresponding to the outside diameter of the nozzle member 52. The outer shell 66 is mounted within the outer housing 43 by means of a plurality of suitable fasteners 70. Between the abutting surfaces of the various telescoping components are notches 71 for O-rings or other suitable sealing means (not shown). The O-rings provide a sealing relationship which prevents leakage which would otherwise adversely affect the quantity and speed of the air flow. The O-rings also prevent particulates, dust and other contaminants from contaminating the various components.

In the preferred embodiment, a portion of the outer surface of the nozzle member 52 has a threaded surface 54 as illustrated in greater detail in FIG. 4. The threaded surface 54 corresponds to threads 76 in the stationary outer shell 66. In this manner, the nozzle member 52 can be rotated with respect to the outer shell 66 by means of the threads 54 so as to longitudinally adjust the nozzle member 52 and the size of the air conduit 57. A suitable tool (not shown) can be attached to a plurality of socket head screws 39 in order to rotate the nozzle member 52 for longitudinal adjustment. Preferably, four screws 39 are located at the inlet end of the nozzle member 52. In the preferred embodiment, the tool which attaches to the screws 39 for rotational purposes is positioned upon a bearing surface 72 which is exposed when the end cap 73 is removed. In the preferred embodiment, the threaded connector 54, 76 has approximately 20 threads per inch. Accordingly, a minimal rotatory adjustment of less than 15° is necessary to adjust the nozzle configuration to obtain the maximum grind rate.

An enlarged, exploded view of the insert piece 74, the nozzle member 52, and the outer shell 66 is illustrated in FIG. 4. To assemble these components, the insert piece 74 is slip fit within the nozzle 52 and the nozzle 52 is inserted within the shell 66. As explained above, the threaded portions 54 on the nozzle and the outer shell are utilized for longitudinal adjustment by means of rotation of the nozzle 52 via fasteners 39.

Different materials to be pulverized require different fluids for entrainment of the particles, although compressed air, steam or other gas are typically used. The fluidizing material is maintained at the proper pressure and temperature according to the material being pulverized and other operating conditions. These temperature and pressure values are well known to those skilled in the art. In the preferred embodiment, compressed air at ambient temperature is utilized. The term "air" as used herein is understood to mean various appropriate motive fluids.

Proximate the discharge end of the nozzle 52 is an air inlet means which directs high-velocity air around the nozzle tip 52 so as to carry the entrained particles at a high velocity and with sufficient force to cause impingement of the particles in the impact chamber 27. The air is supplied by means of a pipe or other suitable means for supplying the motive fluid. The air enters the central nozzle portion 41 of the injector 51 through an opening 55. In the preferred embodiment, the opening 55 or high-pressure inlet is positioned tangentially, being perpendicular to the axis of the nozzle bore 42. The air is preferably under rather high pressure; for example, some applications which obtain particle sizes in the 10 micron (ultrafine) range introduce the high energy fluid stream under a pressure of approximately 100 lbs. per square inch.

The opening 55 is in fluid communication with a cylindrical air manifold 56. One end of the manifold 56 terminates in a wear ring 77 which defines a circumferential passage 57 for the air and which directs the air toward the channel 49 of the barrel 48. As shown in the enlarged view of FIG. 5, the barrel is in fluid communication with the air passage 57. A pair of O-rings 59, 60 are utilized in the preferred embodiment to seal off the manifold 56 and prevent leakage of air and contaminants. The circumferential or conical passage 57 has a generally decreasing cross-section.

In order to inhibit abrasion of the nozzle tip 67 by the particles and to yield a longer operating life, and in order to promote efficient and favorable acceleration of the solid particles relative to prior devices, it is important for the proportions and dimensions of the various components to be sized and configured in a particular way.

It has been determined experimentally that the optimum grinding and the highest production of fine particles occurs when the ratio of the secondary or particle air flow ($Q_2$) is 50% of the primary air flow ($Q_1$) through the conical passage 57. In order to achieve this optimum flow, the ratio of the cross-sectional area of the bore 42 (A1) to the cross-sectional area of the barrel bore 49 (A3) is approximately 0.79. However, the high velocity of the flow at these proportions produces unacceptable wear. In the preferred embodiment, the cross-sectional area of the barrel channel 49 is at least approximately twice as large as the cross-sectional area of the central conduit 42. In the preferred embodiment, the ratio A1/A3 is approximately 0.53. For one exemplary preferred embodiment, D1 is 0.5 inches and D3 is 0.68 inches.

The cross-sectional area of the throat 73 or smallest part of the passage 57 depends upon the flow rate $Q_1$ in the injector 21. One particular example is the case in which $Q_1$ equals 75 s.c.f.m., the $Q_1$ supply pressure is approximately 100 p.s.i., and the back pressure on the nozzle is less than critical. In this case, the area of the throat is 0.0375 square inches, since the desired air velocity is Mach 1 in the throat.

It has also been experimentally determined that in order to achieve the maximum vacuum at the exit plane and to pull the maximum flow $Q_2$, the exit cross-section ($A_e$) area should be twice that of the cross-section area at the throat 73 ($A_t$), which gives an exit velocity in excess of Mach 2. The exit area is the cross-section area at the exit point 74 proximate the nozzle tip 67.

Figure 5:
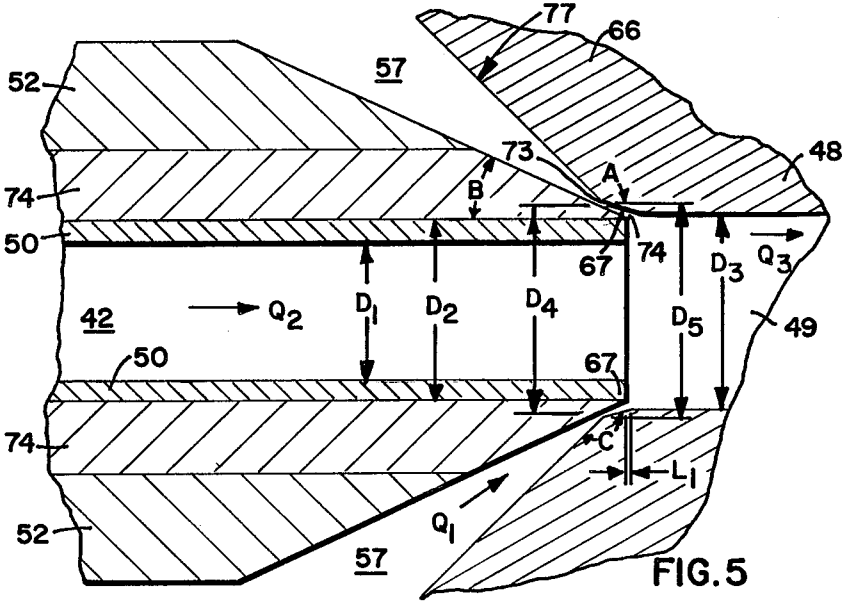
FIG. 5 is an enlarged side sectional view of the injection illustrated in FIG. 2.

The air passage 57 has an inner surface and an outer surface, each surface having an angle of taper with respect to the horizontal. The outer surface of the passage 57 has a first angle of taper (angle C) for substantially all of its length, this surface causing the air passage 57 to converge. The outer surface also preferably has a second angle of taper (angle A) between the throat 73 and the intersection of the passage 57 with the horizontal wall of the barrel 48, the second angle of taper causing the air passage 57 to diverge. In the preferred embodiment, the angle A (the angle of taper of the passage 57 with respect to horizontal between the throat 73 and exit point 74) shown in FIG. 5 is a critical angle. Angle A should be approximately 15° in order to provide the optimal, efficient air flow.

In addition, the angle B, which is the angle of the inner surface of the passage 57 with respect to the horizontal, is approximately 25° in the preferred embodiment. The angles A and B have the above values in order to achieve the optimum ratio $A_e/A_t$. The angle C is preferably at approximately 135° in order to provide for smooth flow of $Q_1$ and to keep the outer diameter of the housing to a minimum size. The angle C is the first angle of taper with respect to horizontal. Consequently, the first angle of taper of the outer surface of the passage 57 with respect to horizontal is approximately 135°. In addition, the value $L_1$, i.e., the distance between the end of the nozzle 67 and the end of the barrel 49, is quite small, on the order of less than approximately 0.030 inch.

The diameter of the central bore 42 and barrel channel 49 are proportional to the amount of flow which the injector 21 is designed to handle. For the $D_1$ and $D_3$ measurements above, $Q_1$ is approximately 70 cubic feet per minute, for a total of 150 c.f.m. for two opposing injectors 21.

The pulverizer 20 of the present invention can be made in a variety of sizes to operate on various quantities of compressed air, typically ranging from approximately 20 to 4500 cu. ft./min. For a given air flow, the grind rate will vary according to the configuration of the nozzle design. Accordingly, it is desirable to adjust the nozzle configuration and consequently the air flow by a small amount so as to achieve the maximum grind rate.

The maximum vacuum occurs at the exit plane, and the highest production of pulverized material or grind rate occurs when a maximum vacuum has been reached at that point. As is well known to those skilled in the art, the vacuum can be measured at the exit plane, and the injector design of the present invention allows the nozzle configuration to be modified so as to achieve the maximum vacuum and maximum grind rate.

The configuration of the nozzle can be adjusted with the injector 21 of the present invention each time a nozzle member 52, liner 50, or barrel 48 is replaced. These components must be periodically replaced due to the abrasive forces of the fast-moving particles.

Around the nozzle tip 67 a vacuum is formed, causing the sand or other substance to be drawn into and through the bore 42 to be joined with the rapid current of steam or gases from the passage 57. The sand is then injected under pressure through the barrel 48 and into the impingement chamber 47 between the outlet of the two barrels 48, where the action of the two opposing currents causes a granular material to be brought into contact with sufficient velocity to reduce the material to a powder by the concussion or embrasion.

It is to be understood that numerous and various modifications can be readily devised in accordance with the principles of the present invention by those skilled in the art without departing from the spirit and scope of the invention. Therefore, it is not desired to restrict the invention to the particular construction illustrated and described but to cover all modifications that may fall within the appended claims.

I claim:

1. An injector for projecting solid material in an impact pulverizer, said injector comprising:

(a) nozzle member having a central conduit with an inlet end and an outlet end, said nozzle member including a nozzle tip proximate said outlet end;

(b) means for circulating solid particles to said inlet end of said conduit;

(c) a barrel positioned proximate said outlet end of said conduit and being in axial alignment with said conduit, said barrel being in horizontal alignment and having a barrel diameter larger than the diameter of said conduit;

(d) a circumferential air passage surrounding said nozzle member, said air passage having an inlet end and an outlet end, said inlet end including an inlet aperture, said outlet end being in fluid communication with said barrel, wherein said air passage has an inner surface an outer surface, each having an angle of taper with respect to horizontal, said outer surface having a first and second angles of taper, the intersection of which forms a throat in said air passage, said first angle of taper extending substantially all of the length of said air passage and causing said air passage to converge and said outer surface having a second angle of taper between the throat and its intersection with the horizontal wall of said barrel which causes said air passage to diverge, said second angle of taper being approximately fifteen degrees; and (e) means for supplying a motive fluid through said inlet aperture so as to direct the fluid tangentially into said air passage.

2. The injector according to claim 1, wherein the first angle of taper is approximately 135 degrees.

3. The injector according to claim 1, wherein the angle of taper of said inner surface is approximately 25 degrees.

4. The injector according to claim 1, wherein the volume rate of flow in said conduit is approximately half of the rate of flow in said air passage.

5. The injector according to claim 1, wherein $A_1$ is the cross-sectional area of said conduit and $A_3$ is the cross-sectional area of said barrel, wherein the ratio of $A_1$ to $A_3$ is approximately 0.53.

6. The injector according to claim 1, wherein an exit plane is the area of said air passage at said outlet end and wherein the throat cross-sectional area is approximately half said exit plane cross-sectional area.

7. The injector according to claim 1, wherein the distance between said nozzle tip and said inlet end is less than 0.03 inches.

8. An injector for projecting solid material in an impact pulverizer, said injector comprising:

(a) a nozzle member having a central conduit of constant cross-section and having an inlet end and an outlet end, said nozzle member including a nozzle tip proximate said outlet end, wherein an outside surface of said nozzle member has a threaded portion about its circumference, said threaded portion corresponding to threads on a stationary housing member which surrounds said nozzle member, wherein rotation of said nozzle member causes longitudinal movement thereof;

(b) means for circulating solid particles to said inlet end of said conduit;

(c) a barrel positioned proximate said outlet end of said conduit and being in axial alignment with said conduit, said barrel being in horizontal alignment and having a barrel diameter larger than the diameter of said conduit so that the cross-sectional area of said barrel is at least approximately twice as large as the cross-sectional area of said conduit;

(d) a circumferential air passage surrounding said nozzle member, said air passage having an inlet end and an outlet end, said inlet end including an inlet aperture, said outlet end being in fluid communication with said barrel, wherein said air passage has an inner surface and an outer surface, each having an angle of taper with respect to horizontal, said outer surface having a first and second angles of taper, the intersection of which forms a throat in said air passage, said first angle of taper extending substantially all of the length of said air passage and causing said air passage to converge and said outer surface having a second angle of taper between the throat and its intersection with the horizontal wall of said barrel which causes said air passage to diverge, said second angle of taper being approximately fifteen degrees; and (e) means for supplying a motive fluid through said inlet aperture so as to direct the fluid tangentially into said air passage.

9. The injector according to claim 8, wherein the first angle of taper is approximately 135 degrees.

10. The injector according to claim 8, wherein the angle of taper of said inner surface is approximately 25 degrees.

11. The injector according to claim 10, wherein the volume rate of flow in said conduit is approximately half of the rate of flow in said air passage.

12. The injector according to claim 10, wherein an exit plane is the area of said air passage at said outlet end and wherein the throat cross-sectional area is approximately half said exit plane cross-sectional area.

13. The injector according to claim 8, wherein the distance between said nozzle tip and said inlet end is less than 0.03 inches.

14. An injector for projecting solid material in an impact pulverizer, said injector comprising:

(a) a nozzle member having a central conduit of constant cross-section and including a cylindrical liner member therein, said nozzle member having an inlet end and an outlet end, said nozzle member including a tapered nozzle tip proximate said outlet end, wherein an outside surface of said nozzle member has threaded portion about its circumference, said threaded portion corresponding to threads on a stationary housing member which surrounds said nozzle member, wherein rotation of said nozzle member causes longitudinal movement thereof;

(b) means for circulating solid particles to said inlet end of said conduit;

(c) a barrel positioned proximate said outlet end of said conduit and being in axial alignment with said conduit, said barrel being in horizontal alignment and having a barrel diameter larger than the diameter of said conduit so that the cross-sectional area of said barrel is at least approximately twice as large as the cross-sectional area of said conduit;

(d) a circumferential air passage surrounding said nozzle member, said air passage having an inlet end and an outlet end, said inlet end including an inlet aperture, said outlet end being in fluid communication with said barrel, wherein said air passage has an inner surface and an outer surface, each surface having an angle of taper with respect to horizontal, said outer surface having a first and second angles of taper, the intersection of which forms a throat in said air passage, said first angle of taper extending substantially all of the length of said air passage and causing said air passage to converge and said outer surface having a second angle of taper between the throat and its intersection with the horizontal wall of said barrel which causes said air passage to diverge, said second angle of taper being approximately fifteen degrees; and (e) means for supplying a motive fluid through said inlet aperture so as to direct the fluid tangentially into said air passage.

* * * * *